US006216563B1

(12) United States Patent
Hsieh

(10) Patent No.: US 6,216,563 B1
(45) Date of Patent: Apr. 17, 2001

(54) REVERSIBLE RATCHET WHEEL POSITIONING ARRANGEMENT FOR A REVERSIBLE RATCHET SOCKET WRENCH

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/559,596

(22) Filed: Apr. 28, 2000

(51) Int. Cl.[7] ..... B25B 13/46
(52) U.S. Cl. ..... 81/63.2; 192/43.2
(58) Field of Search ..... 81/60, 63.1, 63.2; 192/43, 43.2

(56) References Cited

U.S. PATENT DOCUMENTS 2,701,977 * 2/1955 Stone ..... 81/63.2
5,782,147 * 7/1998 Chaconas et al. ..... 81/63.1

* cited by examiner

*Primary Examiner*—James G. Smith
(74) *Attorney, Agent, or Firm*—Varndell & Varndell, PLLC

(57) ABSTRACT

A reversible ratchet wheel positioning arrangement includes a box end body for holding a ratchet wheel, a screw cap detachably threaded into an inner thread in the box end body to hold a ratchet wheel in the box end body, and a toothed stop rod mounted in a transverse hole in the box end body and shifted in the transverse hole between a left position and a right position to limit the direction of the ratchet wheel being installed in the box end body, wherein the stop rod can be rotated in the transverse hole between a first position and a second position subject to the type of teet of the ratchet wheel being isntalled in the box end body.

3 Claims, 7 Drawing Sheets

REVERSIBLE RATCHET WHEEL POSITIONING ARRANGEMENT FOR A REVERSIBLE RATCHET SOCKET WRENCH

BACKGROUND AND SUMMARY OF THE INVENTION

The present invention relates to a reversible ratchet socket wrench, and more specifically to a reversible ratchet wheel positioning arrangement for a reversible ratchet socket wrench, which can be used with different ratchet wheels.

A variety of wrenches, including combination wrenches, hex wrenches, ratchet socket wrenches, etc. have been disclosed, and have appeared on the market. Early designed wrenches are not efficient in use, because the user must release the wrench from the workpiece after each turning through a limited angle, and then repeat the operation again and again. Recently reversible wrenches have become popular. FIGS. 1 and 2 illustrates two different designs of ratchet wheel direction control arrangement for reversible ratchet socket wrench according to the prior art. According to these two designs, a C-shaped retainer ring is mounted in the body end of the wrench to hold a ratchet wheel in the box in the box end, a cylindrical stop rod is mounted in a transverse through hole on the box end body of the wrench, and a steel ball is mounted in a recessed hole on the periphery of the transverse through hole and forced by a spring element into engagement with the cylindrical stop rod. The cylindrical stop rod has toothed portions for engagement with the ratchet wheel. These two designs do not allow the user to replace the ratchet wheel conveniently. Further, the cylindrical stop rod can not stop outside dust or water from passing to the inside of the transverse through hole. FIG. 3 shows another reversible ratchet socket wrench according to the prior art. This design comprises a box end body having a transverse blind hole and a sliding slot perpendiculary disposed in communication with the transverse blind hole, a C-shaped retainer ring fastened to the box end body to hold a ratchet wheel in the box in the box end body, a cylindrical stop rod mounted in the transverse blind hole and moved between two positions to limit the direction of rotation of the ratchet wheel being installed in the box end wrench, a knob fastened to the cylindrical stop rod and extended out of the sliding slot for moving by hand to shift the cylindrical stop rod between the two positions, and a steel ball supported on a spring element inside the box end body and forced by the spring element into engagement with one recessed portion at the cylindrical stop rod, and an end cap covered on the transverse blind hole to stop dust and rain from passing to the inside of the transverse blind hole. This design still can not allow the user to replace the ratchet wheel conveniently.

The present invention eliminates the aforesaid problem. According to the present invention, a screw cap is threaded into an inner thread in the box in the box end of the wrench body to hold a ratchet wheel in the box, and a stop rod is mounted in a transverse hole on the box end body for controlling the direction of rotation of the ratchet wheel in the box in the box end body. The screw cap can be conveniently disconnected from the box end body, enabling the user to replace the ratchet wheel. The stop rod can be rotated in the transverse hole between a first position and a second position subject to the type of teeth of the ratchet wheel being installed in the box end body.

DETAILED DESCRIPTION OF THE PREFERRED EMBODIMENT

Figure 1:
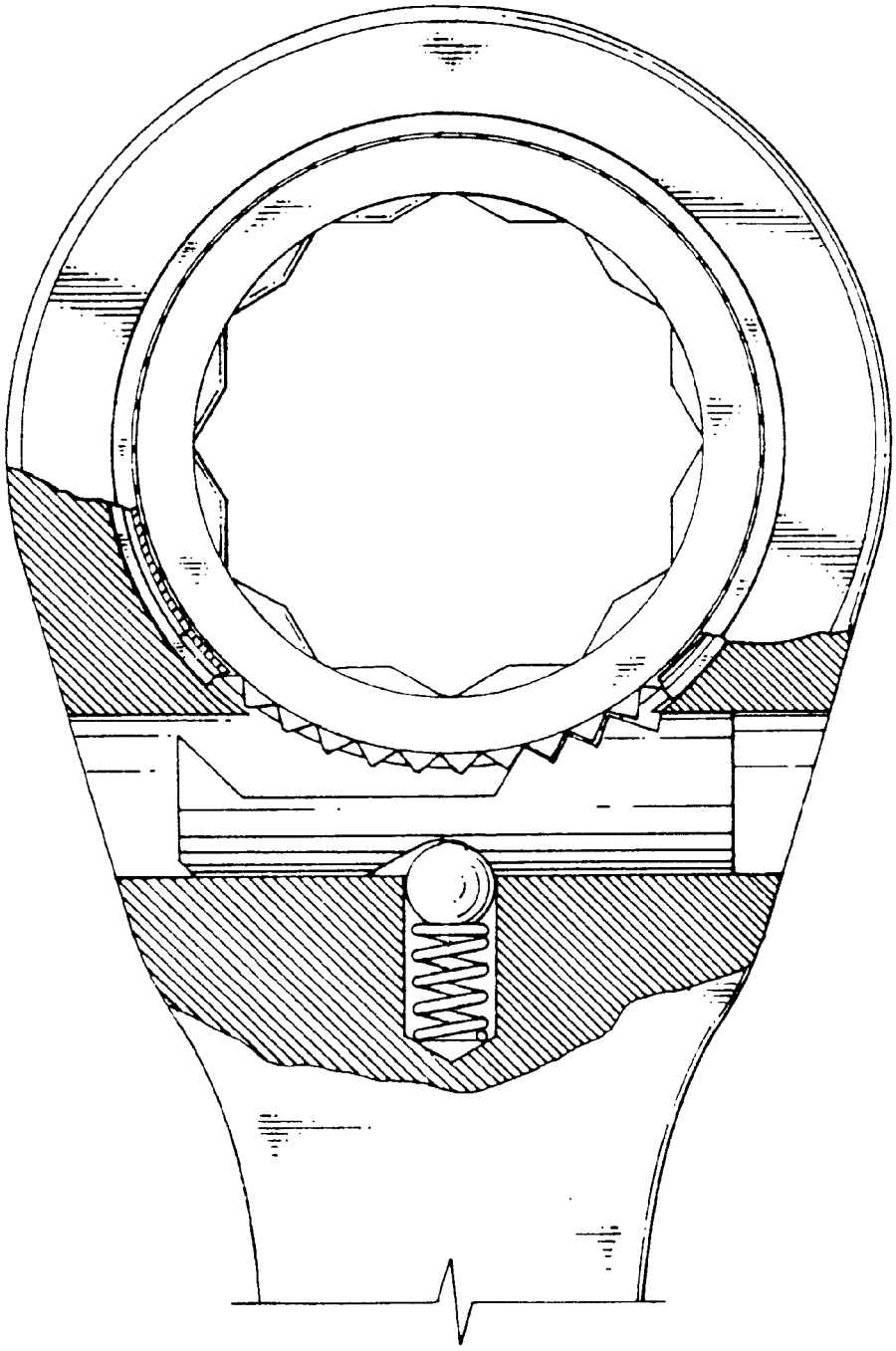
Fig. 1 PRIOR ART
FIG. 1 is a sectional plain view of a reversible ratchet socket wrench according to the prior art.
Figure 2:
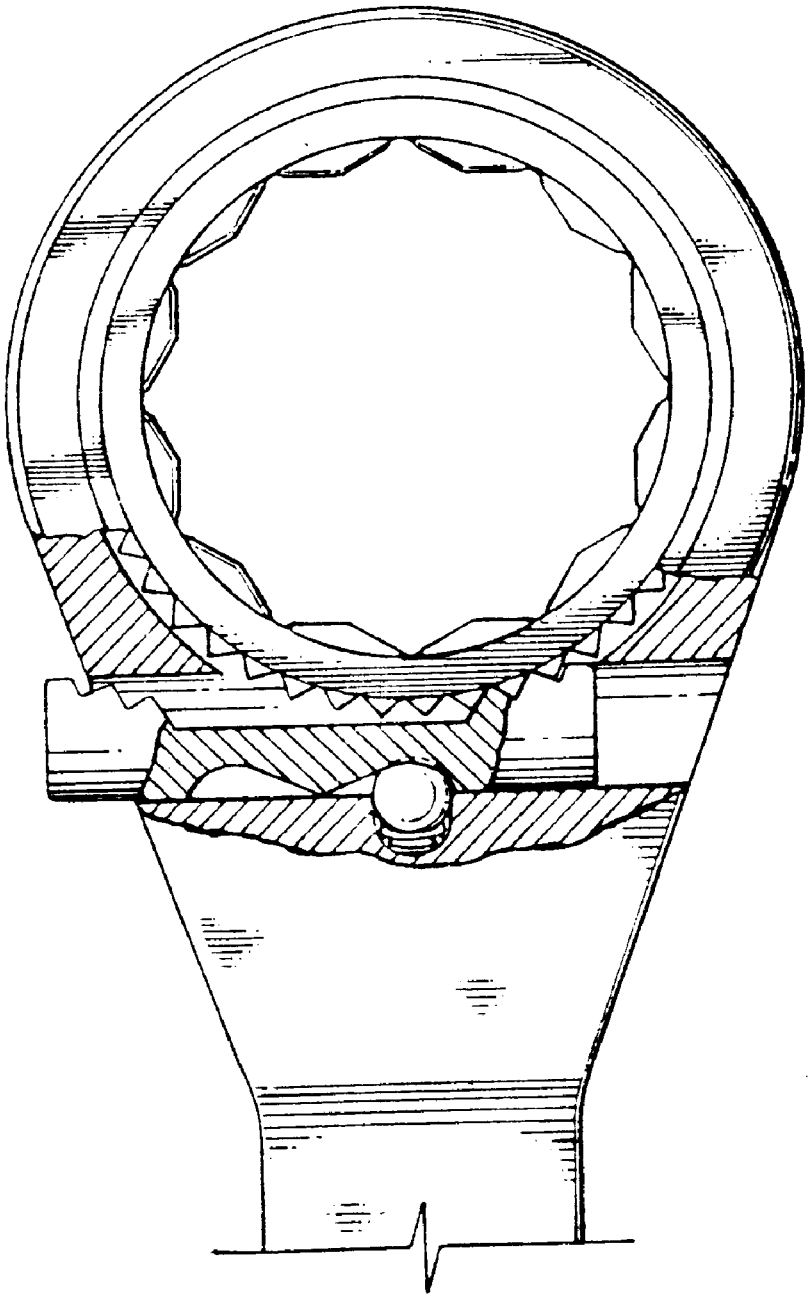
Fig . 2 PRIOR ART
FIG. 2 is a sectional view of another structure of reversible ratchet socket wrench according to the prior art.
Figure 3:
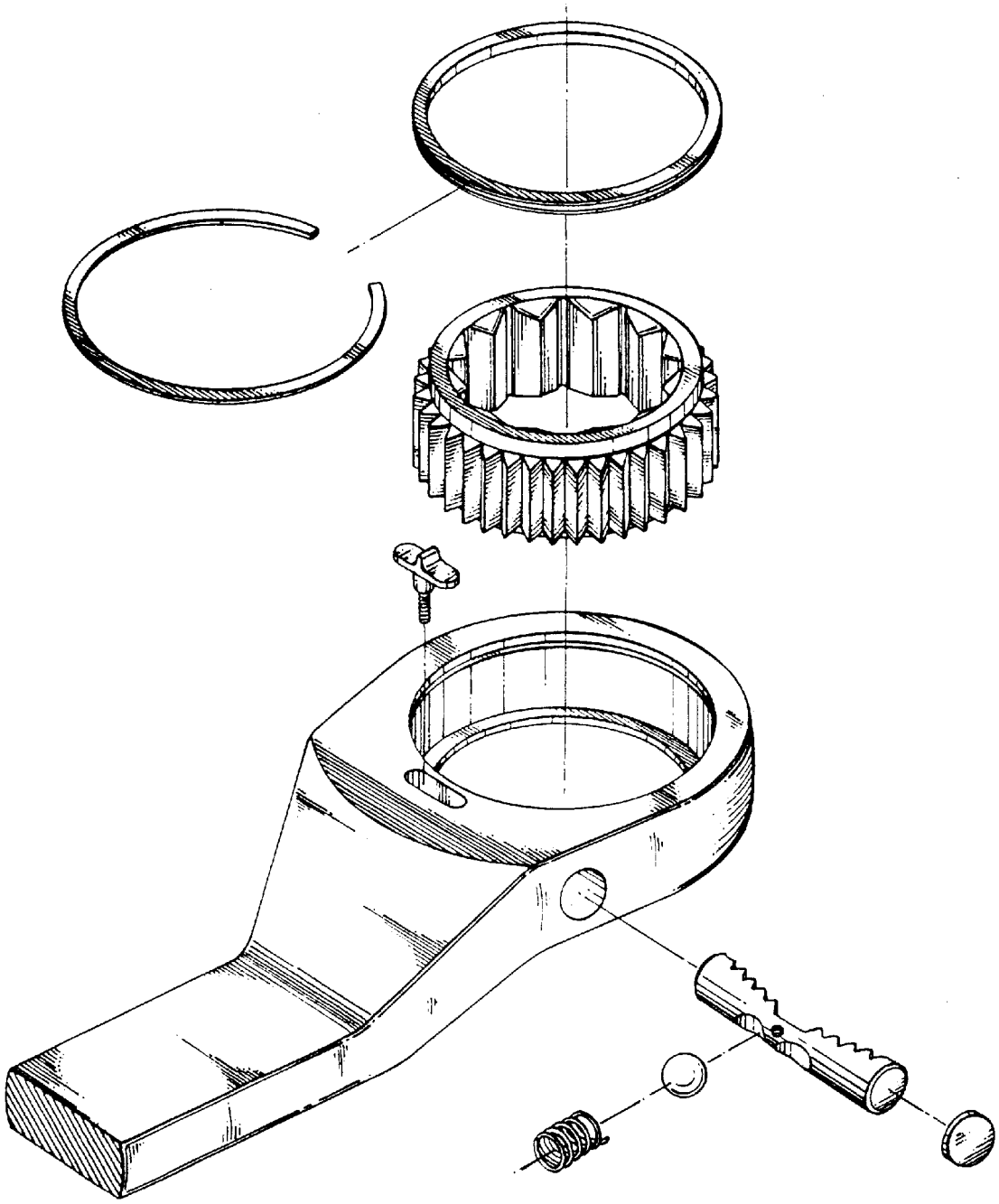
Fig. 3 PRIOR ART
FIG. 3 is an exploded view of still another structure of reversible ratchet socket wrench according to the prior art.
Figure 4:
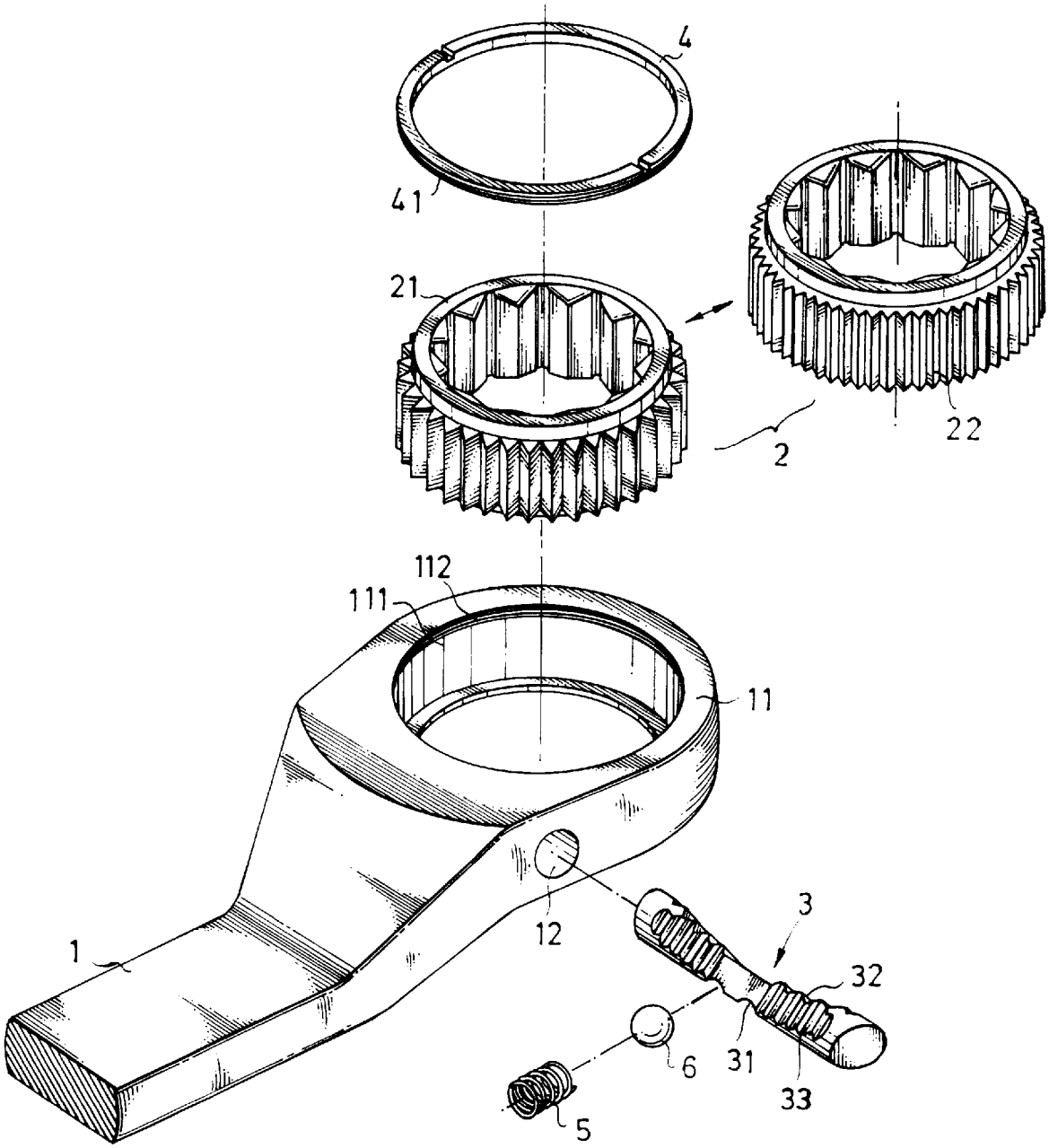
FIG. 4 is an exploded view of the present invention.

Referring to Figures from 4 through 7, the present invention comprises a body 1, a ratchet wheel 2, a stop rod 3, a screw cap 4, a spring member 5, and a steel ball 6.

The body 1 comprises a box end 11 defining a box 111, which receives the ratchet wheel 2, an inner thread 112 in the box 111 at a top side, a transverse hole 12 cut through the periphery of the box 111, which receives the stop rod 3. The ratchet wheel 2 is mounted within the box 111 in the box end 11 of the body 1. The stop rod 3 comprises two pairs of recessed positioning portions 31 spaced at a backside. The stell ball 6 is supported on the spring element 5 in the body 1, and forced by the spring element 5 into engagement with one recessed positioning portion 31 of the stop rod 3. The stop rod 3 can be shifted in the transverse hole 12 between two positons to limit the direction of rotation of the ratchet 2 in the box 111.

The screw cap 4 is a hollow member having an outer thread 41 threaded into the inner thread 112 to hold the ratchet wheel 2 in the box 111. After removal of the screw cap 4 from the box end 11 of the body 1, the ratchet wheel 2 can then be replaced with another one having a different design of teeth 21 or 22. The stop rod 3 comprises two toothed units bilaterally disposed at a front side thereof, each toothed unit comprised of a first toothed portion 32 and a second toothed portion 33 disposed at different angles.

Figure 5:
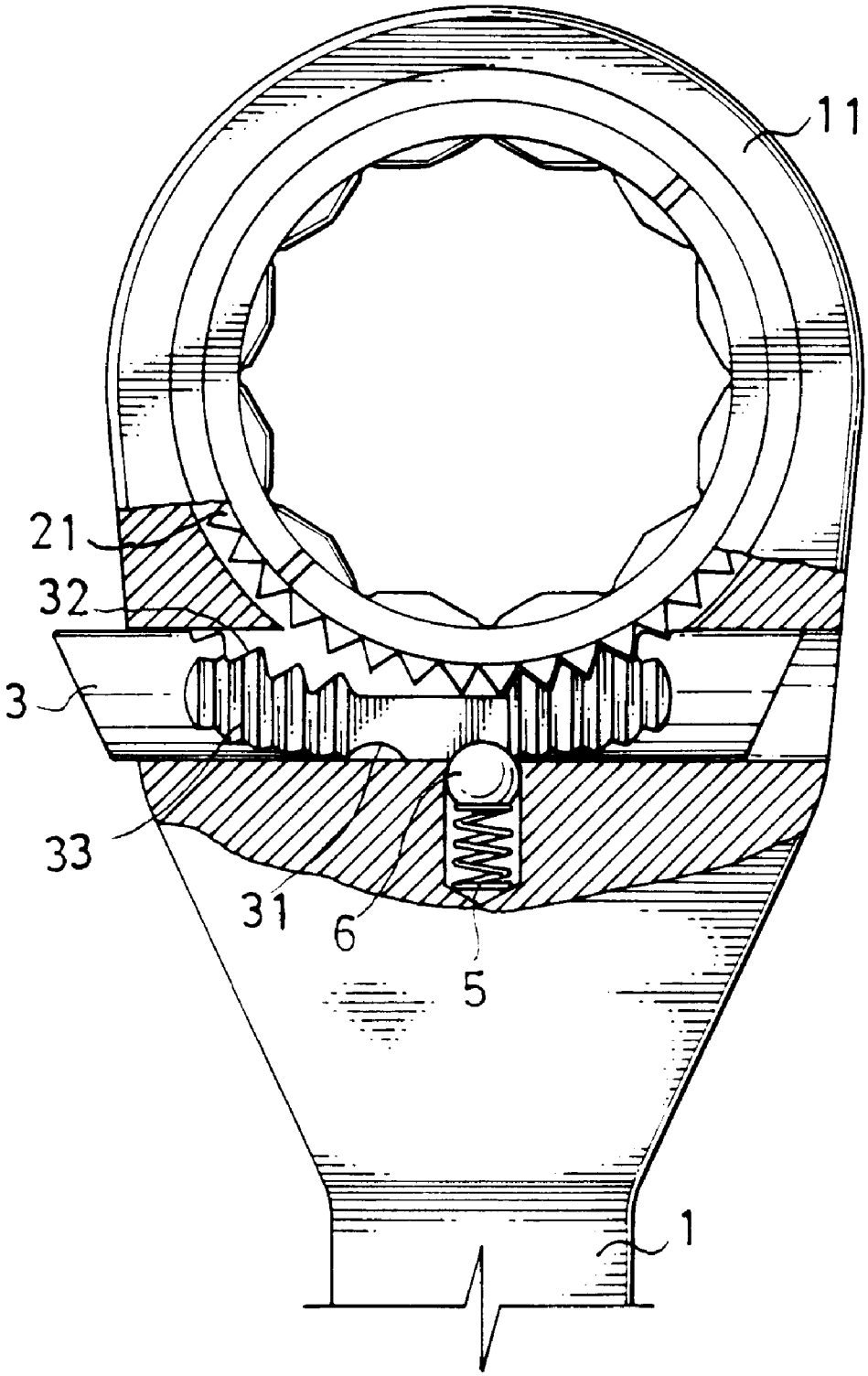
FIG. 5 is a sectional assembly view of the present invention, showing the stop rod shifted to the left position, the corresponding first toothed portion meshed with the ratchet wheel.
Figure 6:
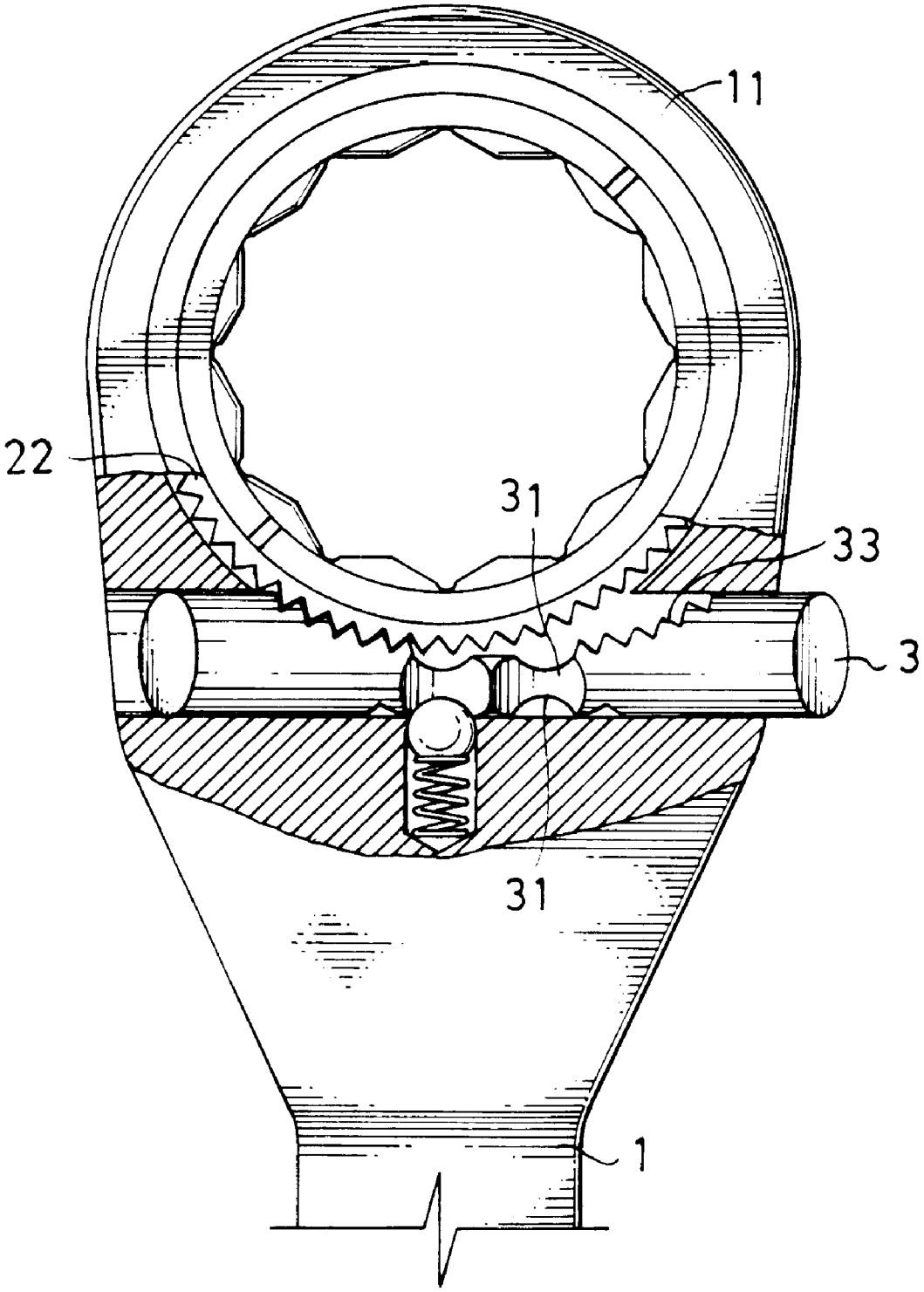
FIG. 6 is similar to FIG. 5 but showing the stop rod shifted to the right position, the corresponding second toothed portion meshed with the ratchet wheel.
Figure 7:
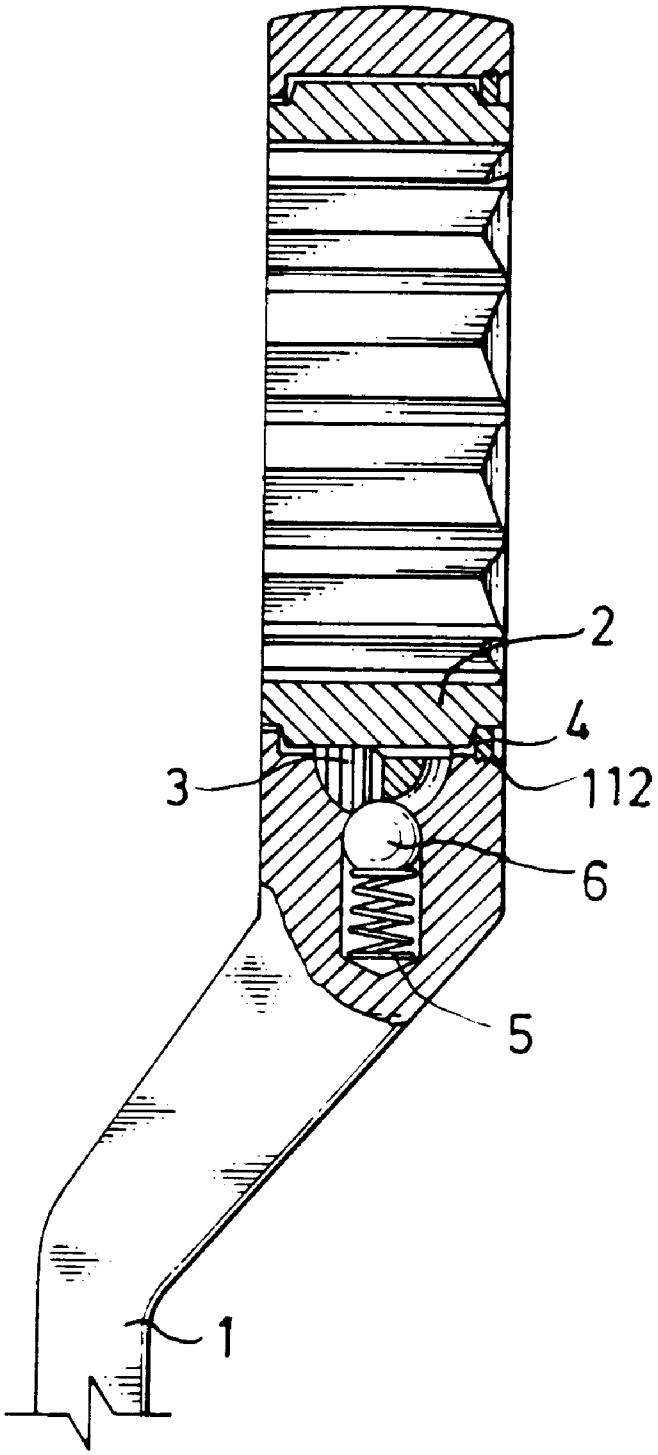
FIG. 7 is a side view in section of the present invention.

The stop rod 3 can be shifted in the transverse hole 12 between the left position (see FIG. 5) and right position (see FIG. 6) to limit the direction of rotation of the ratchet wheel 2. After removal of the screw cap 4 from the box end 11 of the body 1, the user can put the ratchet wheel having coarse teeth 21 or ratchet wheel having fine teeth 22 in teh box 111 inside the box end 11 of the body 1. When the ratchet wheel having coarse teeth 21 is put in the box 111 inside the box end 11 of the body 1, the stop rod 3 is rotated in teh transverse hole 12 to force the first toothed portion 32 of one toothed unit into engagement with the teeth of the ratchet wheel having coarse teeth 21 and one recessed positioning portion 31 into engagement with the steel ball 6. When the ratchet wheel having fine teeth 22 is put in the box 111 inside the box end 11 of the body 1, the stop rod 3 is rotated in the transverse hole 12 to force the second toothed portion 33 of one toothed unit into engagement with the teeth of the ratchet wheel having fine teeth 22, and one recessed positioning portion 31 into engagement with the steel ball 6. Because the first toothed portion 32 fits the coarse teeth of the ratchet wheel having coarse teeth 21 and the second toothed portion 33 fits the fine teeth of the ratchet wheel having fine teeth 22, the two different designs of ratchet wheels 21 and 22 can be alternatively installed in the box end 11 and positively secured in position by the stop rod 3.

Further, because the periphery of the two distal ends of the stop rod 3 fits the inner diameter of the transverse hole 1, the stop rod 3 prohibits dust from entering the transverse hole 12.

While only one embodiment of the present invention has been shown and described, it will be understood that various modifications and changes could be made thereunto without departing from the spirit and scope of the invention disclosed.

What is claimed is:

1. A reversible ratchet wheel positioning arrangement comprising:

a body, said body comprising a box end defining a box for holding a ratchet wheel, and a transverse hole cut through the periphery of said box;

a cap fastened to the box end of said body to hold a ratchet wheel in said box;

a stop rod mounted in said transverse hole in said body and moved in said tranverse hole between a left position and a right position to limit the direction of rotation of the ratchet wheel being installed in said box, said stop rod having two toothed units bilaterally disposed at a front side thereof and alternatively forced into engagement with the ratchet wheel being installed in said box, and a plurality of recessed positioning portions disposed at a back side thereof;

a spring element mounted in said body; and a steel ball supported on said spring element and forced by said spring element into engagement with one recessed positioning portion of said stop rod;

wherein the toothed units of said stop rod each comprise a first toothed portion and a second toothed portion disposed at different angles and turned with said stop rod in said transverse hole between a first position for engagement with the ratchet wheel being installed in said box, and a second position away from the ratchet wheel being installed in said box; said cap is a screw cap detachably threaded into an inner thread in said box end to hold a ratchet wheel in the box in said box end of said body.

2. The reversible ratchet wheel positioning arrangement of claim 1 wherein said first toothed portion and said second toothed portion of each of said toothed units each are formed of a plurality of teeth, the number and pitch of the teeth of said first toothed portion being different from the number and pitch of the teeth of said second toothed portion.

3. The reversible ratchet wheel positioning arrangement of claim 1 wherein the recessed positioning portions of said stop rod are respectively disposed in different angles corresponding to the toothed portions of said toothed units.

* * * * *